United States Patent [19]

Graham

[11] Patent Number: 4,858,411

[45] Date of Patent: Aug. 22, 1989

[54] SECTIONAL SWIMMING POOL CONSTRUCTION

[76] Inventor: C. A. Graham, 725 Colonial Dr., Panama City, Fla. 32404

[21] Appl. No.: 307,216

[22] Filed: Feb. 3, 1989

Related U.S. Application Data

[63] Continuation of Ser. No. 112,457, Oct. 26, 1987, abandoned.

[51] Int. Cl.[4] ..... E04C 2/06; E04G 21/14

[52] U.S. Cl. ..... 52/601; 52/169.7; 52/583; 52/742; 52/745

[58] Field of Search ..... 52/169.7, 169.8, 582, 52/583, 587, 596, 600, 601, 742, 745

[56] References Cited

U.S. PATENT DOCUMENTS

| | | | |
|---|---|---|---|
| 1,912,290 | 5/1933 | Marks | 52/601 |
| 1,953,203 | 4/1934 | Venzie | 52/601 |
| 2,007,148 | 7/1935 | White et al. | 52/601 |
| 2,310,442 | 2/1943 | Knudsen | 52/601 |
| 2,664,740 | 1/1954 | Cochrane | 52/583 |
| 2,954,645 | 10/1960 | Bennett, Jr. | 52/169.7 |
| 3,020,560 | 2/1962 | Bedick | 52/169.7 |
| 3,200,548 | 8/1965 | Gillespie, Jr. | 52/600 |
| 3,228,161 | 1/1966 | McCowen | 52/601 |
| 3,300,937 | 1/1967 | Schyndel et al. | 52/581 |
| 3,555,763 | 1/1971 | Bloxom | 52/583 |
| 3,832,814 | 9/1974 | Teschner | 52/169.7 |
| 3,835,605 | 9/1974 | Ueno | 52/169.7 |
| 3,848,381 | 11/1974 | Bloxom | 52/601 |
| 4,018,021 | 4/1977 | Dow | 52/583 |
| 4,442,648 | 4/1984 | Reece | 52/601 |

FOREIGN PATENT DOCUMENTS

| | | | |
|---|---|---|---|
| 616608 | 3/1961 | Canada | 52/169.7 |
| 2280766 | 2/1976 | France | 52/169.7 |
| 2370842 | 7/1978 | France | 52/169.7 |
| 2416991 | 10/1979 | France | 52/169.8 |
| 708519 | 5/1954 | United Kingdom | 52/601 |

*Primary Examiner*—Michael Safavi

*Attorney, Agent, or Firm*—Thomas C. Saitta

[57] ABSTRACT

An in-ground swimming pool is constructed of sectional panels joined by welding. The panels are formed of poured concrete having lateral ends of metal. Special configuration of internal reinforcing members prevents separation of the metal ends from the concrete body of the sectional panels.

9 Claims, 2 Drawing Sheets

SECTIONAL SWIMMING POOL CONSTRUCTION

This is a continuation of application Ser. No. 112,457 filed Oct. 26, 1987 now abandoned.

BACKGROUND OF THE INVENTION

This invention concerns in-ground swimming pools and particular methods of construction.

There are many methods for constructing in-ground pools, just as there are many types of pools themselves. Pools can be constructed of poured-in-place concrete, sprayed concrete, gunite or other such materials, or even of block and mortar. The walls and bottom of the pool are constructed to be water-tight or are lined with a water impervious liner. In terms of durability, a liner is not preferred. The methods of constructing water-tight, non-lined pools vary in difficulty and expense. For example, poured-in-place concrete pools require labor-intensive careful construction of the forms. Uncontrollable factors such as high ground water or untimely rainstorms can cause problems. The sprayed concrete or gunite methods expose workers to the dangers of using the spray gun, require large amounts of material and result in a weaker construction.

Another method of pool construction involves the use of pre-formed sectional panels to form the walls and/or bottom of the pool. This method has a number of advantages. The required excavations can be dug closer to the actual pool dimensions, as the panels are pre-formed and then placed in position. Pre-forming the panels allows mass production and the panels can be formed when weather conditions are optimum at the site or formed at other locations and transported to the site. Curing time for concrete panels is usually less than curing time for poured-in-place walls. Defective panels can be discarded and replaced without affecting the integrity of the entire pool.

The technique of using pre-formed sectional panels in pool construction is well-known. For example, Eichelman et al., in U.S. Pat. No. 1,908,332, teach the use of such panels. The panels are joined laterally by pouring concrete into vertical channels. Bennett, Jr., in U.S. Pat. No. 2,954,645, teaches pre-formed, reinforced panels which are joined to each other by bolts extending through flanges incorporated into each panel. Posnick, in U.S. Pat. No. 3,739,539, teaches the use of thermoplastic panels joined by a solvent weld formed in a removable clamp, followed by poured concrete.

The method of this invention, as well as the sectional panels themselves and the completed pool, are similar to the examples stated above. The invention is novel and distinct in the particular construction of the sectional panels and the method of joining these panels. The construction of the panels enables them to be joined by a simple metal welding operation, an improvement over the usual joining methods which require solvent or concrete to cure before construction of the pool can continue. In addition, no bolts or flanges are exposed to the damaging effects of corrosion, and the stresses between panels are evenly spread along the entire joint rather than focused at particular points. Construction is simplified since the method does not require exacting tolerances for fit and is readily adaptable to variation in shape, size or contour of the desired pool.

BRIEF SUMMARY OF INVENTION

The subject invention involves a method of pool construction comprising the use of specially constructed concrete sectional panels which are welded at the side joints to form a strong, solid, unitary wall. The invention also consists of the uniquely constructed concrete panels themselves and the pool made using such panels under this method. The concrete panels are formed of poured concrete and have reinforcing members running horizontally and vertically. Both lateral ends of the concrete panels culminate in a metal piece formed such that two panels can be placed adjacent, end-to-end, and then welded together along the contacting region of the two metal pieces. The reinforcing members are specially configured to prevent separation or twisting of the end metal pieces away from the concrete portion of the panel. The vertical reinforcing members extend a distance beyond the panel on both the top and bottom, enabling the panel to be interconnected with the pool bottom itself and the horizontal decking surface during final construction of the complete pool structure. The invention is such that pools of any size and shape can be constructed using the method and articles described, including curved or free-form pools.

DETAILED DESCRIPTION OF THE INVENTION

In-ground pool construction using pre-formed sectional panels begins with excavation of a hole slightly larger in area than required for the finished pool, especially along the sides of the pool, to provide room for access to the pool wall sections during assembly. In general, a sectional pool is constructed by excavating the hole, pre-forming the sectional panels for the side wall, assembling the side wall panels into a unitary assemblage, forming the pool bottom to integrally connect with the side wall assemblage, forming the decking portion to integrally connect with the side wall assemblage, and then performing a variety of finishing steps to insure non-leakage and provide a pleasing interior on the surface of the pool.

The invention will be described in terms of flat, rectangular panels, three feet in height, eight feet in length and approximately three and five-eighths inches in thickness, used in the construction of rectangular pools having planar walls, but it is to be expressly understood that the invention can be embodied in any pre-formed panel of differing dimensions and shape necessary to create a sectional pool of curved or free-form shape as well.

Figure 1:
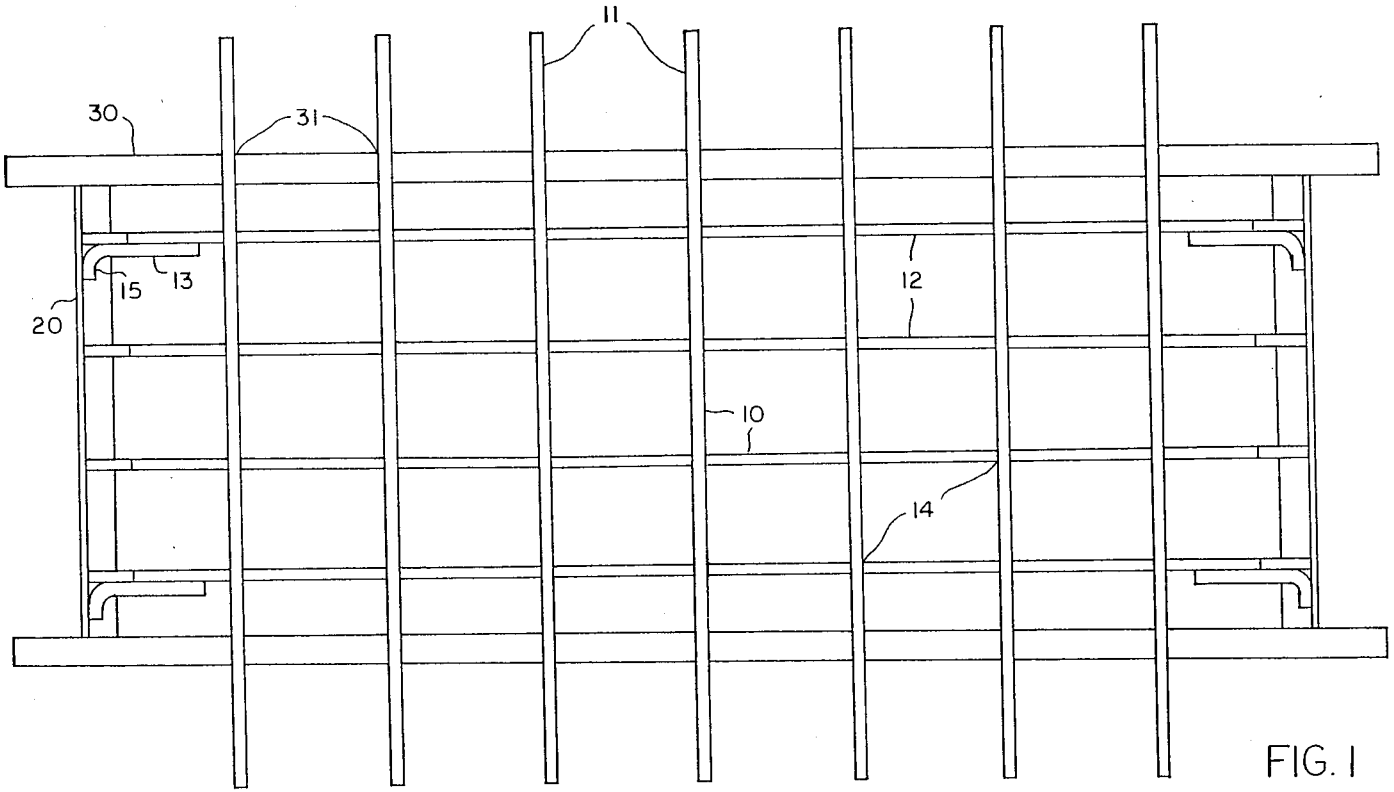
FIG. 1 is a view from above of the assembled form for receiving concrete to create a sectional panel, illustrating the placement of the angle irons, wooden pieces and reinforcing members.

The sectional wall-panels are constructed of concrete, reinforcing members and metal end pieces. With reference to FIG. 1, the reinforcing members are reinforcing rods 10 extending both horizontally and vertically within the panel. The reinforcing rods 10 can be of the common steel type, three-eighths inch in diameter, rod-shaped and capable of being bent in a jig to shape. For a finished panel size of three feet vertical and eight feet lengthwise, seven five-foot reinforcing rods are cut to be used as vertical members 11, and four eight-foot reinforcing rods are cut to be used as horizontal members 12. Two three-foot pieces of angle iron 20 (also known as L-bars) are cut for use as the metal and pieces, the angle iron being a right-angle configuration with one side being three inches wide and the other two inches. Four one-foot sections of the reinforcing rods are cut for use as end braces 13.

The two angle irons 20 are placed on a horizontal surface suitable for serving as the bottom of a form-mold for poured concrete. The two angle irons 20 are placed in parallel, eight feet apart, such that the three inch side extends vertically from the surface and the other side of each angle iron 20 rests on the surface and is disposed in the direction of the other angle iron 20. The vertical side of each angle iron 20 will thus form one outer end of each sectional panel 90, and the horizontal side of the angle iron 20 will be planar with the back side of the formed sectional panel 90.

Figure 2:
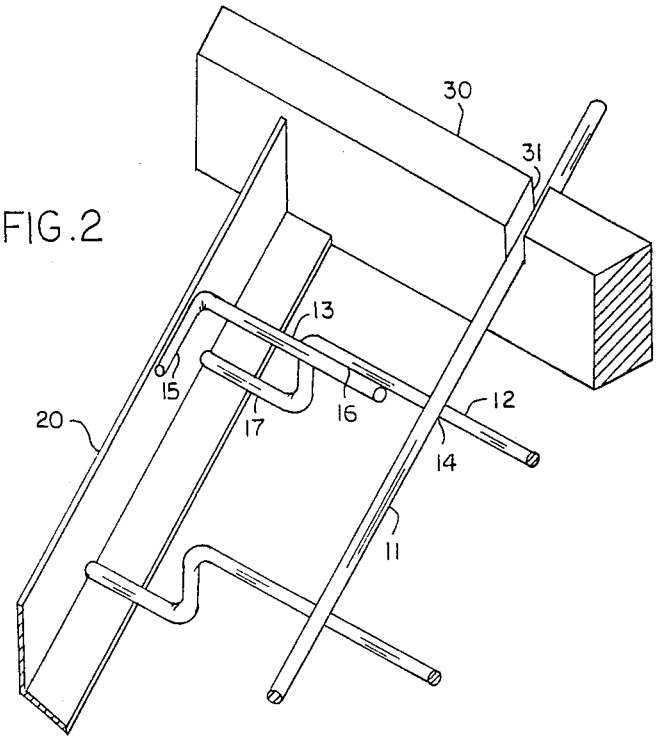
FIG. 2 is a view of one corner of the assembled form for receiving concrete to create a sectional panel, illustrating the positioning of the reinforcing members.

Referring now to FIG. 2, the horizontal reinforcing rods 12 are bent twice at each end such that the last three inch portion 17 of each rod is parallel to the main body of the rod 12, but is disposed off the axis of the main body of rod 12 approximately one and one half inches in the radial direction. Each end of the rod 12 is then welded to the interior of the horizontal side of angle iron 20. The rod 12 is positioned such that the main body of the rod 12, because of the bends at each end, is situated approximately one and one half inches above the horizontal surface. The main body of each rod 12 will thereby occupy a position approximately in the center of each finished three inch panel 90. The four horizontal rods are evenly spaced along the angle irons 20, all parallel to one another, with the top and bottom rods placed approximately four inches from the respective ends of the angle irons 20.

The four reinforcing rod end braces 13 are each bent at a ninety degree angle approximately three inches from one end to form retaining braces for the angle irons 20. The short bent section 15 is welded along the vertical side of the angle iron 20 such that the bent section is parallel to the upper edge of the angle iron but does not extend above it. The longer end of each of these end braces 13 abuts the raised portion of the outermost horizontal reinforcing rods 12 and is welded to said rod along the region of contact 16. This construction prevents the vertical side of the angle iron 20 from bending or pulling away from the finished sectional panel 90 during and after construction of the pool wall.

Referring again to FIG. 1, abutted against the upper end of each angle iron 20 is a piece of cut lumber 30, approximately two inches by four inches and at least eight feet in length. Another similar piece is abutted against the lower end of each angle iron 20. These two pieces of lumber 30, together with the vertical sides of the angle irons 20, form the mold walls for receiving the poured concrete, and define the final size and shape of the sectional panel 90. Evenly spaced along each piece of lumber 30 are seven notches 31 approximately three-eights inch wide and one and one half inches deep. Into these notches 31 are placed the seven vertical reinforcing rods 11 such that each rod extends approximately one foot beyond the lumber 30 on each end. The vertical reinforcing rods 11 and horizontal rods 12 are welded together at their intersections 14 using conventional techniques.

A sufficient amount of wet concrete, approximately eight cubic feet, is now poured over the reinforcing structure in order to completely fill the mold as defined by the angle irons 20 and the pieces of lumber 30. The concrete is smoothed and beveled down at each end so that the edge of the three inch side of the angle iron 20 remains exposed. Upon curing, the wood members 30 are removed and the concrete sectional panel 90 is now ready to be installed. It is most efficient to use a separate mold for each sectional panel 90 and to pour each at the same time.

As described, each sectional panel 90 is approximately eight feet long by three feet high and three and five-eights inch thick. The two lateral ends are composed of the exposed three inch side of angle irons 20. The top and bottom of sectional panel 90 are concrete with one foot sections of the vertical reinforcing rods 11 extending outward.

Figure 3:
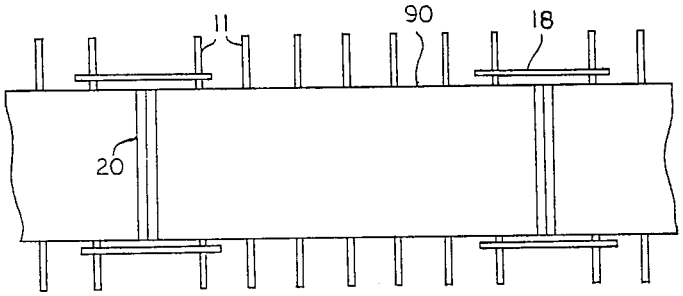
FIG. 3 is a view of the rear or exterior side of completed sectional panels which have been welded together.

To install each panel 90, the pool excavation is dug and concrete blocks are placed as footing at the ends of the sectional panels. The sectional panels 90 are placed side by side, as shown in FIG. 3, so that the angle irons 20 of each are in contact along their entire length. A continuous weld using conventional techniques, for example, arc welding, is performed along the contact region of the angle irons 20 facing the exterior of the pool and spot-welding is performed along the interior side. This results in a complete seal between each panel 90 which, after finishing plaster is applied to form a smooth surface, prevents any leakage of water from the pool. Short sections of reinforcing bars may be added as joint bars 18, which are welded between the extended sections of the outermost vertical reinforcing rods 11 of adjacent panels 90 to further stabilize the joints.

Figure 4:
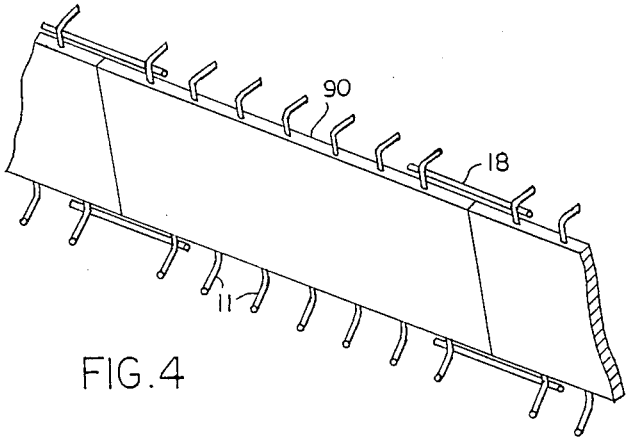
FIG. 4 is a view of the front or interior side of completed sectional panels which have been welded together, showing the vertical reinforcing members bent to accommodate incorporation into the deck and pool bottom.

Referring now to FIG. 4, the reinforcing rods 11 which extend below the sectional panels are bent inward and can be connected by welding to whatever reinforcing structure is used for the pool bottom. The pool bottom is then poured, which encases the extended reinforcing rods 11 and the bottom of the sectional panels 90, thus securing them in place and creating a unitary surface. The exterior excavation is backfilled and the deck is formed, the reinforcing rods 11 extending from the top of each sectional panel 90 being bent outward to be welded to the reinforcing members of the deck, thus locking in the tops of the sectional panels 90.

It is to be understood that varying the shape of a given pool may require changes of the proportions used as set forth above. The above dimensions are given by way of example only. Likewise, different pool shapes may require the use of angle irons formed at a different angle, to insure that continuous contact is maintained between each end of given sectional panels. Different configurations of the reinforcing rods may also be required for different panel shapes. One skilled in the art could readily substitute equivalent materials without going beyond the scope of this invention, as set forth and defined by the following claims.

I claim:

1. A sectional panel used for the construction of swimming pools, said panel being generally rectangular in shape and comprised of concrete, reinforcing members, end braces and exposed metal end pieces having a right-angle configuration, such that the panel has two major sides and two lateral ends; where each lateral end is comprised of one side of one of the metal end pieces and the other side of the metal end piece is parallel with one of the sides of the sectional panel; where one or more of the reinforcing members is attached at an end thereof to each metal end piece on the side of the metal end piece parallel to the side of the sectional panel; and end braces are attached to one or more of the reinforcing members and to each of the metal end pieces on the side forming the lateral ends.

2. The panel of claim 1, where the one or more reinforcing members attached to said metal end pieces are bent at an angle near the attached end.

3. The panel of claim 2, where the one or more reinforcing members attached to said metal end pieces is bent at a right angle and then bent again at another right angle to form an end portion and a main body portion, such that the end portion is parallel to the main body portion of the reinforcing member.

4. A method for the construction of swimming pools using sectional panels, comprising:

A. Excavating a hole in the round sufficient in size to contain all or part of the completed pool;

B. Preforming individual sectional panels generally rectangular in shape constructed of concrete, reinforcing members end braces and metal end pieces having right-angle configurations; where said preforming includes the steps of creating a mold to receive poured concrete in an interior space by placing two disposable mold sides opposite each other on a horizontal surface and placing said metal end pieces on the horizontal surface opposite each other to form the remaining walls of the mold, such that a horizontal side of the metal end piece rests on the horizontal surface and a vertical side of the metal end piece extends perpendicularly from the horizontal surface; situating reinforcing members within the interior space of the mold such that some of the reinforcing members rest on the horizontal side of the metal end pieces; attaching one or more of said reinforcing members to each of said metal end pieces on the horizontal side of the metal end piece; attaching end branches to one or more of the reinforcing members and to each of the metal end pieces on the vertical side of the metal end pieces; filling the interior space of the mold with poured concrete and allowing said concrete to harden; removing the disposable sides of the mold;

C. joining said individual sectional panels to form walls by welding together said metal end pieces of adjacent panels;

D. performing finishing work to unify the entire pool structure.

5. The method of claim 4, further comprising the steps of forming the reinforcing member to be attached to the metal end piece by bending one or both ends of the reinforcing member at an angle to form a main body portion and an end portion, such that the main body of the reinforcing member will be positioned in the approximate middle of the mold after attachment to the metal end piece; and further attaching a shorter segment of reinforcing member material to the reinforcing member near the bend to form an end brace.

6. The method of claim 5, where the reinforcing member is bent at a ring angle and then bent again at a right angle to form the end portion, such that the end portion of the reinforcing member attached to the metal end piece is parallel to the main body of the reinforcing member.

7. The method of claim 6, where the steps of attaching are performed by welding.

8. The method of claim 7, where the step of situating reinforcing members in the interior space of the mold includes placing said reinforcing members such that they intersect and further welding said reinforcing members to each other at the point of intersection.

9. The method of claim 8, further comprising placing reinforcing members in the interior space of the mold such that some of said reinforcing members extend beyond the disposable mold sides.

* * * * *